United States Patent [19]

Jones-Fenleigh

[11] 4,188,036

[45] Feb. 12, 1980

[54] BOARD GAME WITH LETTER SHAPED PLAYING PIECES

[75] Inventor: Edward J. Jones-Fenleigh, Oadby, England

[73] Assignee: Invicta Plastics Limited, Oadby, England

[21] Appl. No.: 877,886

[22] Filed: Feb. 15, 1978

Related U.S. Application Data

[63] Continuation-in-part of Ser. No. 752,534, Dec. 20, 1976, abandoned.

[51] Int. Cl.[2] ..... A63F 3/00

[52] U.S. Cl. ..... 273/265

[58] Field of Search ..... 35/35 H, 71; 40/622; 273/265, 272

[56] References Cited

U.S. PATENT DOCUMENTS

| | | | |
|---|---|---|---|
| 2,447,122 | 8/1948 | Horst, Jr. | 56/330 |
| 2,958,961 | 11/1960 | Wheeler | 35/73 |
| 3,184,908 | 5/1965 | Rust | 86/330 |
| 3,344,591 | 10/1967 | Christie et al. | 56/330 |
| 3,449,895 | 6/1969 | Perches | 56/330 |
| 3,494,117 | 2/1970 | Weygandt et al. | 56/330 |
| 3,545,761 | 12/1970 | Brooks | 273/265 |
| 3,613,343 | 10/1971 | Sagousre et al. | 56/330 |
| 3,654,712 | 4/1972 | Bagdasar | 35/71 X |
| 3,690,054 | 9/1972 | De Carlo et al. | 56/330 |
| 3,827,222 | 8/1974 | Toti | 56/330 |
| 3,861,205 | 2/1971 | Baker | 56/328 R |
| 4,022,473 | 5/1977 | Foley | 273/280 X |
| 4,059,273 | 11/1977 | Kindred | 273/265 |
| 4,073,493 | 2/1978 | Moreland | 273/148 R |

FOREIGN PATENT DOCUMENTS

| | | | |
|---|---|---|---|
| 478690 | 10/1975 | Australia | 273/265 |
| 466763 | 7/1950 | Canada | 273/272 |

*Primary Examiner*—Harland S. Skogquist

*Attorney, Agent, or Firm*—Charles E. Brown

[57] ABSTRACT

The invention provides a board game for two players to test their deductive abilities. The game comprises a board, a holder, a set of playing pieces, a set of marking elements, a set of scoring elements, and a word list, the board having a number of rows of playing areas which serve as test areas for a player's attempts to duplicate a hidden code word chosen by the player's opponent.

2 Claims, 8 Drawing Figures

BOARD GAME WITH LETTER SHAPED PLAYING PIECES

This application is a continuation in part of U.S. Ser. No. 752,534, filed Dec. 20, 1976 and since abandoned.

BACKGROUND OF THE INVENTION

This invention is concerned with board games and in particular with a game to be played between two players. It has been devised with the object of providing for a stimulating exercise of the reasoning and logical thinking processes of the participants.

BRIEF DESCRIPTION OF THE INVENTION

For this purpose, the game is based on the principle of comparing in a lighthearted way the deductive abilities and fortuitousness of the two players in solving arbitrarily-selected code words. The invention therefore provides a board game for two players comprising a board, a holder, a set of playing pieces, a set of marking elements, a set of scoring elements and a word list; the board having a playing surface divided into a plurality of similar rows of individual playing areas each area having a hole to receive a playing piece, a score area and marking areas, each of the marking areas being associated with a row of playing areas, each marking area being adapted to receive a maximum number of marking elements equal to the number of playing areas in a row, the scoring area comprising lines of apertures, each aperture adapted to receive a scoring element; the holder having a row of target playing areas, each target playing area having a hole to receive a playing piece, and a shield, the number of target playing areas in said row being equal to the number of playing areas in a row of the board, and the shield being locatable over said target playing areas by a first player to shield playing pieces mounted thereon from a second player, the playing pieces being a set of moulded letters, each having a projection at a base portion thereof, said projection being receivable in a hole in one of the playing areas of the board or one of the target playing areas of the holder; and the word list having thereon a list of words from which a code word may be chosen by the first player as a target for the second player.

The apparatus may further include a grid for storing playing pieces and marking and scoring elements prior to use in play.

The code elements may comprise a plurality of tablets marked with individual letters of the alphabet. The board may comprise recesses or channels to receive these tablets in rows to form words, these being the "attempts" to break the code. The code itself may be constituted by a selection of these letters held in a frame.

Alternatively the code elements may comprise a plurality of letters, preferably moulded in plastic, each having a projection which may be inserted into a slot provided in each of a number of playing areas provided on the board.

BRIEF DESCRIPTION OF THE DRAWINGS

Embodiments of the apparatus will now be described with reference to the accompanying drawings. It will be understood that the description is given by way of example only, and not by way of limitation of the invention.

In the drawings:

In FIG. 1 a first example board is generally designated 1. It is provided with a shallow frame 2 bounding an area 3 for receiving tablets used in playing the game. These tablets are square and each carries an individual letter of the alphabet. FIG. 2 shows a holder 4 which is used to carry the tablets 5 selected as the code word in a particular round of a game. As will be observed from FIG. 1, the rows to receive the tablets in the progress of a game are matched at one side by holes 6 to receive marker pegs required in playing the game.

In FIG. 3 a second example board is generally designated 10, and is provided with four legs **10*a* (only three of which are shown in FIG. 3) and a playing area divided into ten transverse rows of four square playing areas 14 each of which is provided with a rectangular slot 15, aligned transversely of the board 10, for receiving a code letter playing piece during play. A suitable code letter is shown in FIG. 4** and will be described later.

Figure 5:
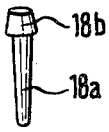
FIG. 5 is a perspective illustration on an enlarged scale of a marker peg for use with the boards shown in FIGS. 1 and 3.

Each transverse row of areas 14 has, alongside, a group of four holes 17 each of which may during play receive a marker peg 18, one of which is shown in FIG. 5.

On a side of the rows of areas 14 remote from the groups of holes 17, two longitudinal rows of holes 19 are provided, a marker peg of the type shown in FIG. 5, but of a different colour, being placed in each row so that a tally of the players score may be kept. The holes 19 in each row are preferably numbered.

Figure 1:
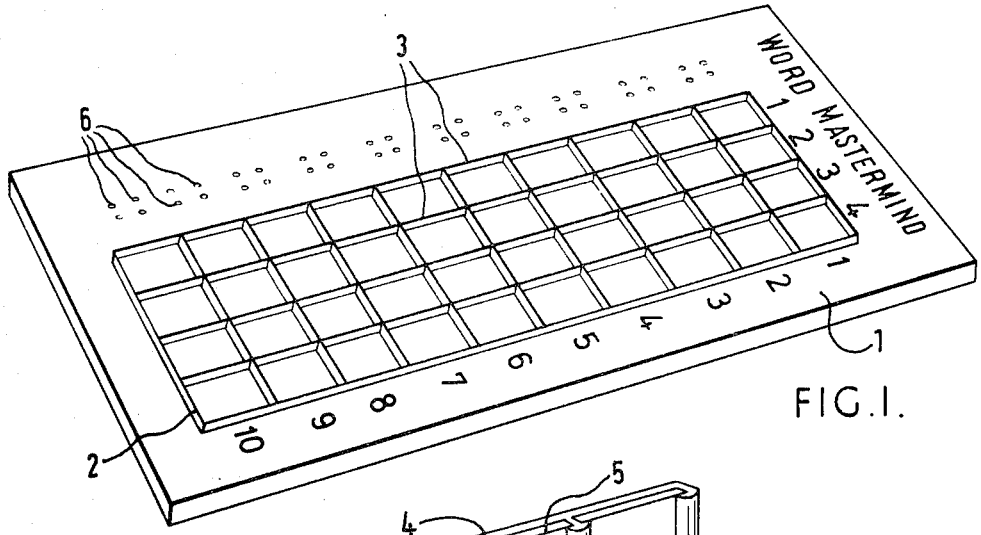
FIG. 1 is a perspective illustration of a first example board used in playing a game involving the use of words.
Figure 2:
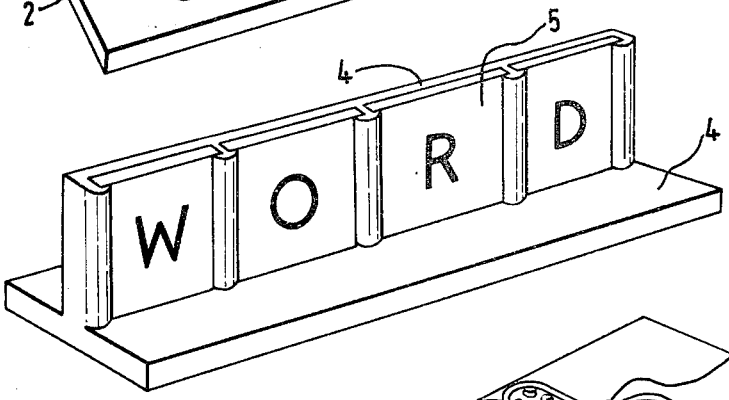
FIG. 2 is a perspective illustration of a frame for holding a code word, suitable for use with the board shown in FIG. 1.
Figure 3:
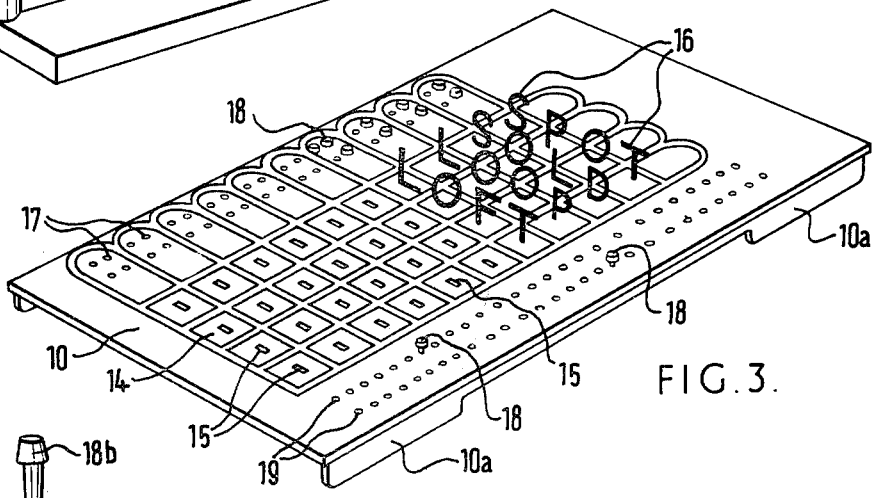
FIG. 3 is a perspective illustration of a second example board used in playing a game involving the use of words, shown as set up during the course of play.
Figure 4:
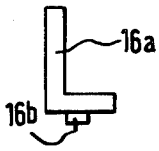
FIG. 4 is a perspective illustration on an enlarged scale of a playing piece for use with the board and frame shown in FIGS. 3 and 6 respectively.

FIG. 4 shows a letter 16 comprising a moulded plastic letter **16*a* having a lug 16*b* integral therewith and insertable within one of the slots 15**.

FIG. 5 shows a marker peg 18 comprising a tapered shank **18*a* having a rounded head 18*b***.

Figure 6:
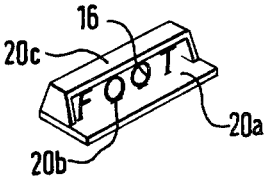
FIG. 6 is a perspective illustration of a holder for holding a code word, suitable for use with the board shown in FIG. 3.

A holder 20 is shown in FIG. 6 and comprises a base **20*a* having four slots 20*b*, similar to the slots 15 in the board 10, and a detachable cover 20*c*. The frame is used to carry up to four letters 16** constituting a selected target code word.

Figure 7:
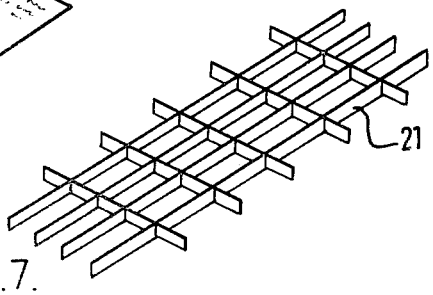
FIG. 7 is in perspective illustration on a reduced scale of a grid for use in storing code letters for use in conjunction with the board and frame shown in FIG. 3.

A plastic grid 21 as shown in FIG. 7 is provided and is placed in a cardboard box (the same box being used to store the components of the game which are shown in FIGS. 3–8 when not in use). The grid 21 when positioned in the said box provides a multi-compartment tray within the components of which the letters 16 may be segregated according to character.

The game in fact is played in accordance with the following set of rules:

This game is played by two players. They play a series of rounds in each of which one party (the "codebreaker") seeks to guess the secret code word chosen by the other party (the "codemaker") and points are awarded to the codemaker for the number of attempts required by the codebreaker to break the chosen code word. The players change roles after each round, the previous codemaker becoming the codebreaker, and vice versa. The game ends when one of the two players is first to accumulate a pre-arranged number of points and the players have had an equal number of turns as codebreakers.

Figure 8:
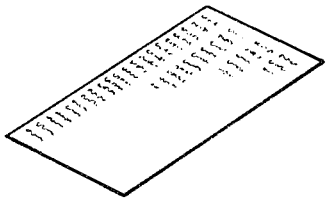
FIG. 8 is an illustration on a reduced scale of a word sheet from which a word may be selected as target word.

The game is played as follows:

The players toss to decide who shall be the codemaker for the first round. This codemaker selects a four-letter code word, preferably from a wordsheet as shown in FIG. 8, and inserts the letters in the code frame out of sight of the codebreaker. The latter then makes his first attempt to reproduce this code word by inserting a set of four letters in the first row on the board. This attempt is then marked by the codemaker. He will place in the group of marking holes alongside the codebreaker's first attempt (a) a black marker peg for any correct letter in correct position, and (b) a white number peg for any correct letter but in a wrong position. If no chosen letter has appeared, no marker peg will be inserted. A suitable peg is shown in FIG. 5.

The codebreaker will then make his second attempt and be marked, and so on until he has discovered the code word. The number of attempts required will be marked down to the codemaker.

The game will be continued until one of the players has achieved a set number of points, say 20, for an equal number of rounds played.

Variations of the game can be devised by the participants. For example they may find it more convenient to limit it to three-letter words, or to limit it to particular kinds of code word, such as nouns, animal names or geographical words.

What is claimed is:

1. A board game for two players comprising a board, a holder, a set of playing pieces, a set of marking elements, a set of scoring elements and a word list; the board having a common horizontal playing surface divided into a plurality of similar rows of individual playing areas, each area having a slot to receive a playing piece, a score area and marking areas, each of the marking areas being associated with a row of playing areas, each marking area being adapted to receive a maximum number of marking elements equal to the number of playing areas in a row, the scoring area comprising lines of apertures, each aperture being adapted to receive a scoring element; the holder having a row of target playing areas, each target playing area having a hole to receive a playing piece, and a separate shield, the number of target playing areas in said holder row being equal to the number of playing areas in a row of the board, and the shield being removably locatable over said target playing areas by a first player to shield playing pieces mounted thereon from a second player, the playing pieces being a set of moulded pieces each in the configuration of a letter of an alphabet, each piece having a tongue at a base portion thereof, said tongue being receivable in a selected slot in one of the playing areas of the board or one of the target playing areas of the holder so that each piece stands independently with respect to its playing area; and the word list having thereon a list of words from which a code word may be chosen by the first player as a target for the second player.

2. A board game for two players as set forth in claim 1 wherein there is additionally provided a grid for the storage of playing pieces, marking elements and scoring elements before play.

* * * * *